US006425150B1

(12) United States Patent
Cheng

(10) Patent No.: US 6,425,150 B1
(45) Date of Patent: Jul. 30, 2002

(54) PLAYYARD SYSTEM WITH CANOPY

(76) Inventor: Kenny Cheng, No. 16, Lane 47, Chih Feng St., Taipei (TW)

( * ) Notice: Subject to any disclaimer, the term of this patent is extended or adjusted under 35 U.S.C. 154(b) by 0 days.

(21) Appl. No.: 09/745,326

(22) Filed: Dec. 21, 2000

(51) Int. Cl.[7] ..... A47D 7/00; E04H 15/00

(52) U.S. Cl. ..... 5/97; 5/416; 135/125; 135/138

(58) Field of Search ..... 5/97, 93.1, 98.1, 5/414, 416; 135/124, 125, 128, 136, 138; 52/726.1; 403/361, 383

(56) References Cited

U.S. PATENT DOCUMENTS

| | | | | | |
|---|---|---|---|---|---|
| 2,820,468 | A | * | 1/1958 | Park et al. | 5/97 X |
| 2,927,331 | A | * | 3/1960 | Ruiz | 5/97 |
| 2,958,084 | A | * | 11/1960 | Kenney | 5/97 X |
| 3,814,058 | A | * | 6/1974 | Thompson | 119/482 |
| 3,821,822 | A | * | 7/1974 | Borreggine | 5/109 |
| 4,590,956 | A | * | 5/1986 | Griesenbeck | 135/116 |
| 4,706,696 | A | * | 11/1987 | Gillis | 135/138 X |
| 4,790,340 | A | * | 12/1988 | Mahoney | 5/414 X |
| 4,852,598 | A | * | 8/1989 | Griesenbeck | 135/138 X |
| 4,945,584 | A | * | 8/1990 | LaMantia | 5/97 |
| 5,517,707 | A | * | 5/1996 | LaMantia | 5/97 |
| 5,862,548 | A | * | 1/1999 | Gerhart | 5/97 X |
| 5,930,854 | A | * | 8/1999 | O'Neill et al. | 5/97 X |
| 6,109,280 | A | * | 8/2000 | Custer | 5/97 X |
| 6,119,288 | A | * | 9/2000 | Hendrickson | 5/97 |
| 6,131,217 | A | * | 10/2000 | Kasem | 5/97 X |
| 6,131,218 | A | * | 10/2000 | Wang | 5/97 X |
| 6,148,455 | A | * | 11/2000 | Kasem | 5/97 X |
| 6,263,894 | B1 | * | 7/2001 | LaMantia | 5/97 X |

FOREIGN PATENT DOCUMENTS

| | | | | |
|---|---|---|---|---|
| CA | 681598 A | * | 3/1964 | 135/125 |
| GB | 1322225 | * | 7/1973 | 5/97 |

* cited by examiner

*Primary Examiner*—Robert G. Santos
(74) *Attorney, Agent, or Firm*—Harness, Dickey & Pierce, P.L.C.

(57) ABSTRACT

A playyard system including a playyard structure and a canopy is provided. The canopy is detachably mounted onto a top frame of the playyard structure by directly connecting support members of the canopy with improved connecting end portions to corresponding corner blocks of the playyard with improved connecting grooves thereby the playyard system may be manufactured with fewer component number and lower cost.

4 Claims, 5 Drawing Sheets

PLAYYARD SYSTEM WITH CANOPY

FIELD OF THE INVENTION

The present invention relates generally to a playyard system an d more particularly, to a playyard system with improved canopy connecting structure.

BACKGROUND OF THE INVENTION

Playyards have been available for many years to provide a convenient and controlled play environment for children. Because playyards are increasingly used in outdoor environment, exposure to sunlight and insects is more common. Therefore, recent advances have been made to enhance the protection of the children inside the playyard from the sunlight and the insects, such as mosquitoes and bees. One example of a playyard system with a canopy is disclosed in U.S. Pat. No. 5,682,548 to Glenn. As shown in FIG. 1, the Glenn disclosed a playyard system 100 which includes a playyard structure 102 and a canopy 104. The playyard structure 102 includes a top frame, a floor portion and four vertical posts connecting the top frame and the floor portion. The canopy 104 includes a cloth consisting of a first face 108 and a second face 110 and a support member 130 inserted within a sleeve 128 located along the interface of the first and second faces 108, 110. The canopy 104 is mounted to the playyard structure 102 by inserting the ends of the support member 130 into connecting member 136 provided at the posts of the playyard structure 102.

This type of playyard system requires additional components to have a canopy mounted thereon. Thus, there is a need for a playyard system that can provide a safe and comfortable environment with fewer component number and lower manufacturing cost.

SUMMARY OF THE INVENTION

One object of the present invention is to provide a playyard system with improved canopy connecting structure for mounting a canopy thereon so as to provide a safe and comfortable environment.

Additional features and advantages of the invention will be set forth in the description which follows, and in part will be apparent from the description, or may be learned by practice of the invention. The objectives and advantages of the invention will be realized and attained by the structure particularly pointed out in the written description and claims hereof as well as the appended drawings.

To achieve this and other objects and according to the purpose of the present invention, as embodied and broadly described, the playyard system includes a playyard structure and a canopy detachably mounted onto a top of the playyard structure. The playyard structure includes a top frame, a floor portion, four vertical posts connecting the top frame and the floor portion and four sides with each side being formed between each pair of adjacent posts, wherein the top frame includes four tubes and four substantially L-shaped corner blocks connecting the tubes to form a rectangular frame. Each of the corner blocks has a bulge portion formed between two arm portion thereof with an accurate groove formed in the bulge portion at a position near the corner. The canopy consists of a cloth having two sleeves provided thereon and two support members extending through the sleeves respectively. Each of the support members has a connecting portion at each of its ends and the connecting portion is configured such that it can be inserted into the arcuate slot of the bulge of the corner block to detachably mount the canopy onto the playyard structure.

According to one embodiment of the present invention, the support member includes a tube body and two connecting portions, wherein the tube body consists of a number of sections each having a connecting ping at its ends and a number of flanges disposed between sections for connecting sections as one tube body and disposed at both ends of the tube body for connecting the connecting portions.

According to the other embodiment of the present invention, one portion of the canopy is formed of mesh material which provides both visibility and ventilation. This mesh material formed portion is zippered to the rest portion of the canopy so as to provide access to the interior of the playyard.

It is to be understood that both the forging general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principle of the invention. In the drawings.

DETAILED DESCRIPTION OF THE INVENTION

Figure 1:
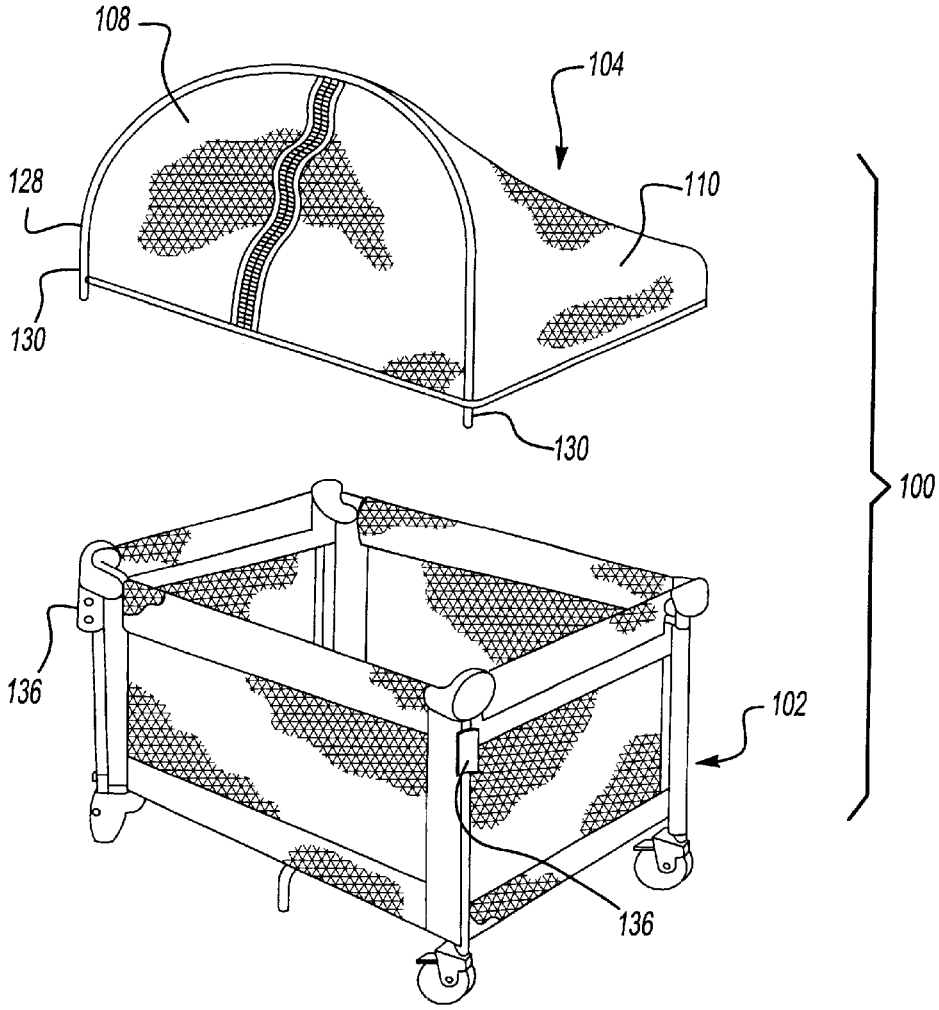
Fig-1 PRIOR ART
FIG. 1 is a perspective view illustrating a traditional playyard system having a canopy.
Figure 2:
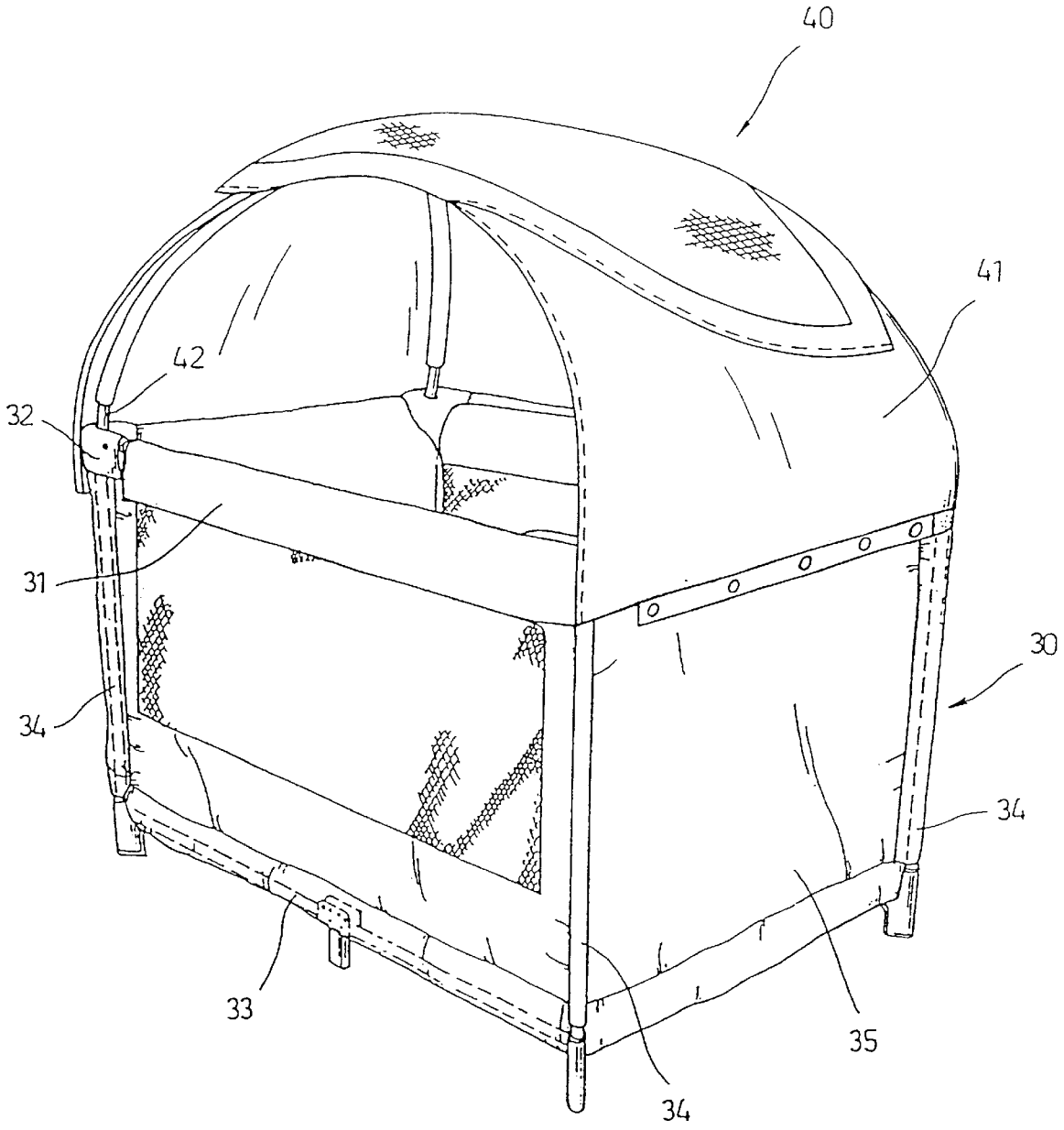
FIG. 2 is an exploded perspective view of an assembled playyard system having a canopy according to the present invention.
Figure 3:
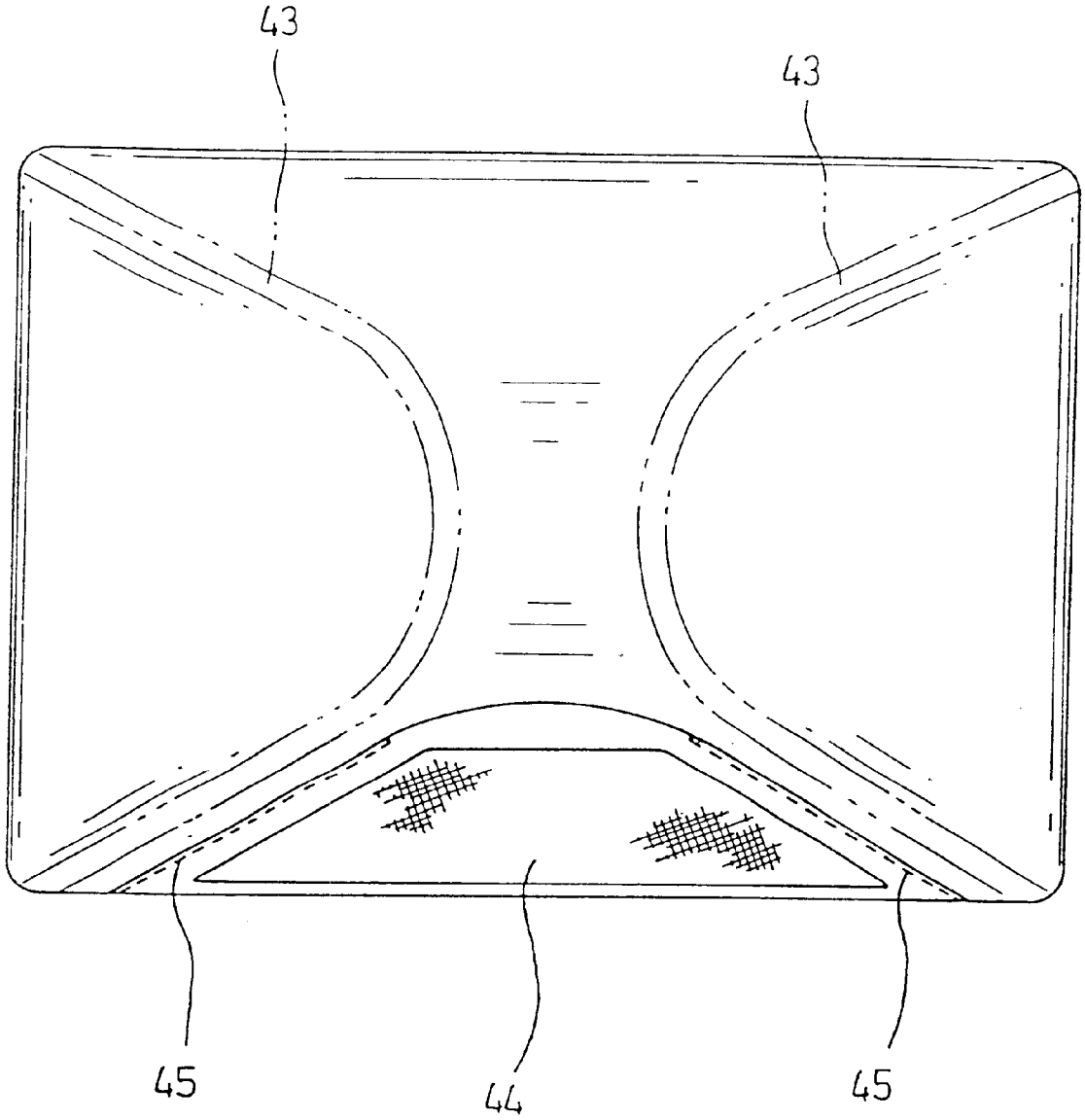
FIG. 3 is a top plane view of the canopy of the playyard system shown in FIG. 1.

Referring now to FIG. 2, a playyard system according to the present invention includes a playyard structure 30 and a canopy 40. The playyard structure 30 mainly includes a substantially rectangular top frame 31 which consists of four tubes and four corner blocks 32, a floor portion 33, four vertical posts 34 for connecting the top frame 33 and the floor portion 33, and four sides 35, each side being formed between each pair of adjacent posts 34. The structure of the floor portion 33 and the top frame 31, and the connection between the top frame and the posts 34 and the floor portion 33 and the posts 34 are well known in this art and an example of these structures are described in U.S. Pat. No. 5,819,432, the entire disclosures of which are incorporated herein by this reference.

Referring now to FIG. 2, a playyard system according to the present invention includes a playyard structure 30 and a canopy 40. The playyard structure 30 mainly includes a substantially rectangular top frame 31 which consists of four tubes and four corner blocks 32, a floor portion 33, four vertical posts 34 for connecting the top frame 33 and the floor portion 33, and four sides 35, each side being formed between each pair of adjacent posts 34. The structure of the floor portion 33 and the top frame 31, and the connection between the top frame and the posts 34 and the floor portion 33 and the posts 34 are well known in this art and an example of these structures are described in U.S. Pat. No. 5,819,432, the entire disclosure of which are incorporated herein by this reference.

Figure 4:
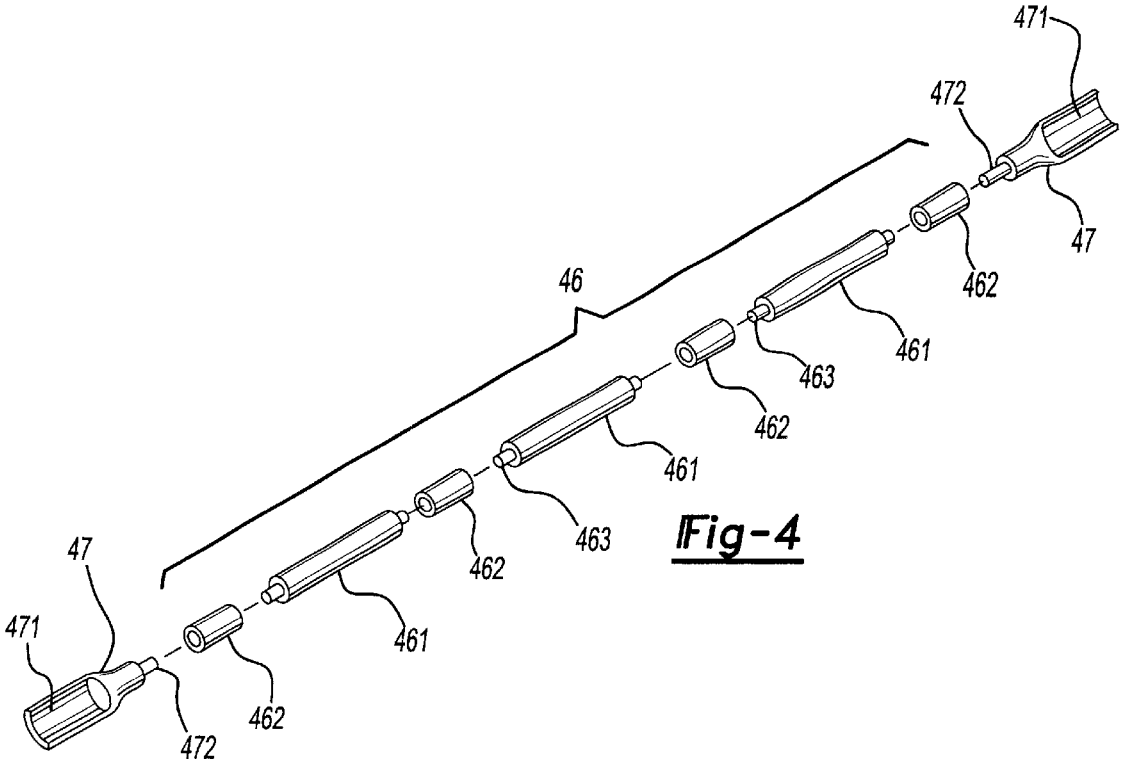
FIG. 4 is an exploded perspective of the support member of the canopy of the present invention.

Referring now to FIG. 4, the support member 42 includes a tube body 46 and two connecting portions 47, wherein the tube body 46 consists of a number of sections 461, each having a connecting ping 483 at its ends and a number of flanges 462 disposed between sections 461 for connecting sections into one tube body 46. One end 471 of each of the connecting portions 47 is shaped as a shuffle. The other end 472 has a configuration similar the that of the connecting pin 463 such that it may connect to the flange 462 at the end of the tube body 46. The tube body 46 is preferably made of elastic materials, such as low density polyethylene (LPE), such that it may have sufficient resilient. The connecting portion 47 is preferably made of rigid materials, such as polystyrene (PS), such that it may have sufficient rigidity.

Figure 5:
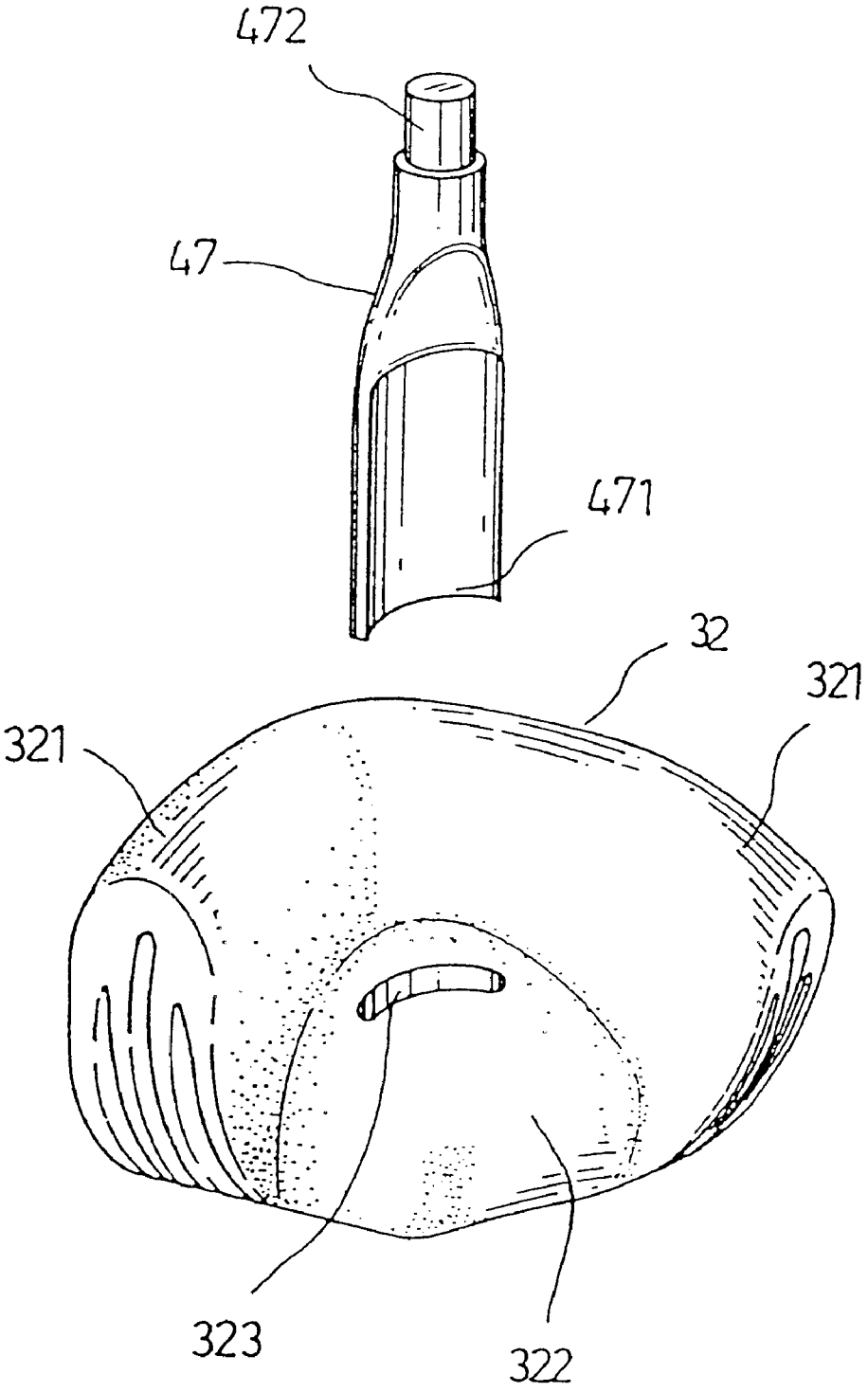
FIG. 5 is an enlarged perspective view of the corner block and the connecting portion of the support member of the present invention.

Referring now to FIG. 5, it illustrates the details of the corner block 32 and the connecting portions 47. As shown in FIG. 5, the corner block 32 has a substantially shape and there is a bulge portion 322 formed between its two arms 321. Further, a groove 323 is formed in the bulge portion 322 at a position close to the corner and has a curvature corresponding to that of the shovel like end of the connecting portion 47 of the support member 42 and thereby the canopy 40 may be mounted to the playyard structure 30 by inserting the connecting portions 47 of the support member 42 into the grooves 323 of the corner blocks 32.

This invention has been disclosed in terms of specific embodiments. It will be apparent that many modifications can be made to the disclosed structures without departing from the invention. Therefore, it is the intent of the appended claims to cover all such variations and modifications as come within the true sprit and scope of this invention.

What is claimed is:

1. A playyard system comprising a playyard structure and a canopy detachably mounted onto a top of the playyard structure, wherein the playyard structure includes a top frame including four tubes and four substantially L-shaped corner blocks connecting the tubes to form a rectangular frame, a floor portion, four vertical posts connecting the top frame and the floor portion and four sides, each side being formed between pairs of adjacent posts, and the canopy consists of a cloth having two sleeves provided thereon and two support members each having two ends extending through the sleeves respectively, wherein each of the corner blocks has a bulge portion formed between two arm portions thereof with an arcurate groove formed in the bulge portion at a position near an outer edge thereof and each of the support members has a connecting portion at each of its ends and each connecting portion is configured such that it can be inserted into the arcurate groove of the bulge portion of the corner block so as to detachably mount the canopy onto the playyard structure.

2. A playyard system as claimed in claim 1, wherein each support member comprises:

a tube body including a number of sections, each having a connecting pin at its ends and a number of flanges disposed between the sections for said connecting section into one tube body; and said two connecting portions, one end of each of the connecting portions being shaped as a shovel and the other end having a configuration similar to that of a connecting pin such that it may connect to the flange at an end of the tube body.

3. A playyard system as claimed in claim 1, wherein one portion of the cloth of the canopy is made of mesh and said mesh material portion is zippered to the rest of the cloth so as to provide an access to an interior of the playyard structure.

4. A Playyard system as claimed in claim 2, wherein the tube body of each support member is made of resilient materials and the connection portions are made of rigid materials.

* * * * *